US011486107B1

(12) United States Patent
Daniel et al.

(10) Patent No.: US 11,486,107 B1
(45) Date of Patent: Nov. 1, 2022

(54) FLOOD CONTROL SYSTEM

(71) Applicant: Portadam, Inc., Williamstown, NJ (US)

(72) Inventors: Jyothish Daniel, Williamstown, NJ (US); Kristin Alzheimer, Williamstown, NJ (US)

(73) Assignee: PORTADAM, INC., Williamstown, NJ (US)

( * ) Notice: Subject to any disclaimer, the term of this patent is extended or adjusted under 35 U.S.C. 154(b) by 0 days.

(21) Appl. No.: 17/484,052

(22) Filed: Sep. 24, 2021

(51) Int. Cl.
*E02B 3/10* (2006.01)

(52) U.S. Cl.
CPC ..... *E02B 3/106* (2013.01)

(58) Field of Classification Search
CPC . E02B 3/106; E02B 7/20; E02D 19/02; E02D 19/04; B65D 90/047
See application file for complete search history.

(56) References Cited

U.S. PATENT DOCUMENTS 4,136,995 A * 1/1979 Fish ..... E02B 7/005 210/162
4,511,286 A * 4/1985 Hardacre ..... E02B 3/106 405/91

(Continued)

FOREIGN PATENT DOCUMENTS

EP 2257675 A1 12/2010
EP 3356606 A1 8/2018

(Continued)

*Primary Examiner* — Benjamin F Fiorello
(74) *Attorney, Agent, or Firm* — Heslin Rothenberg Farley & Mesiti P.C.; Victor A. Cardona, Esq.

(57) ABSTRACT

A system for use in diverting a liquid includes a substantially impermeable liner and a plurality of supporting structures connectable to each other and configured for supporting the liner and a liquid when the liquid is received in a portion bounded by the liner. A first supporting structure of the plurality of supporting structures includes a first dam phase, a first brace and a first base connecting said first dam face to said first brace. A second supporting structure of the plurality of supporting structures includes a second dam face, a second brace and a second base connecting the first dam face to the second brace. The first base is configured to be located on a ground surface to support the first supporting structure and the second base is configured to be located on the ground surface to support the second supporting structure. The first dam face and the second dam face contact and support the liner. The first dam face is connected to and inclined upwardly away from a first lower end of the first base. The second dam face is connected to and inclined upwardly away from a second lower end of the second base. The first dam face is connected to an upper end of the first brace and a second dam face is connected to a second upper end of the second brace. The first dam face is supported by the first brace and the second dam face is supported by the second brace. A plurality of link bars connects the first dam face and the second dam face. The plurality of link bars is vertically spaced from each other along longitudinal dimensions of the first dam face and the second dam face. The first dam face and the second dam face include slots on contacting surfaces of the first dam face and the second dam face contacting the liner. The slots receive the plurality of link bars connecting the first dam face and the second dam face.

33 Claims, 16 Drawing Sheets

(56) References Cited

U.S. PATENT DOCUMENTS

| | | | | |
|---|---|---|---|---|
| 6,079,904 | A * | 6/2000 | Trisl | E02B 3/106 405/116 |
| 6,238,137 | B1 * | 5/2001 | Whitworth | B09C 1/00 405/38 |
| 6,840,711 | B1 * | 1/2005 | Martinez | E02B 3/106 405/15 |
| 8,434,967 | B2 | 5/2013 | Nero | |
| 8,662,335 | B2 * | 3/2014 | Van Romer | B65D 88/22 220/9.1 |
| 9,120,619 | B2 * | 9/2015 | Hoopes | B65D 90/205 |
| 9,157,205 | B1 * | 10/2015 | Novotny | B65D 90/047 |
| 10,458,084 | B2 | 10/2019 | Nero | |
| 2003/0156903 | A1 * | 8/2003 | Wiseman | E02B 3/106 405/114 |
| 2004/0265063 | A1 * | 12/2004 | Kullberg | E02B 3/106 405/114 |
| 2012/0230768 | A1 * | 9/2012 | Rowland | E02B 3/106 405/114 |
| 2012/0261414 | A1 | 10/2012 | Mann et al. | |

FOREIGN PATENT DOCUMENTS

| | | | |
|---|---|---|---|
| WO | 2009103429 | A1 | 8/2009 |
| WO | 2017055079 | A1 | 4/2017 |

* cited by examiner

*FIG. 5*
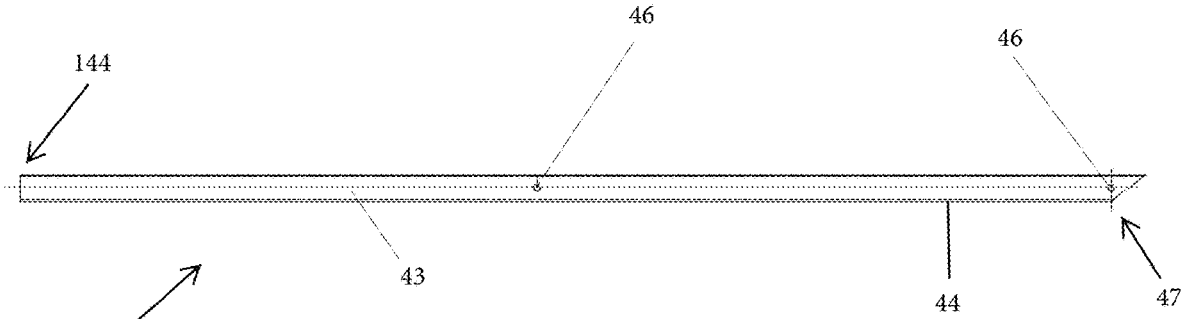
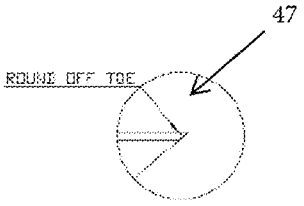
*FIG. 6*
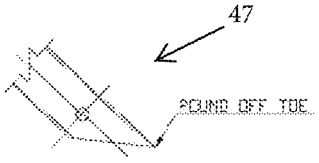
*FIG. 7*

FLOOD CONTROL SYSTEM

TECHNICAL FIELD

The present invention relates to configurable and deployable modular flood control systems and methods.

BACKGROUND OF THE INVENTION

Flood control and water diversion may be necessary in a variety of situations. Natural disasters including hurricanes and other storms may require water to be diverted from particular locations to avoid flooding and the resulting property and human costs. Water diversion may also be necessary to allow construction or maintenance in a particular location, such as a hydroelectric or water storage dam.

Thus, a need exists for systems and methods for diverting liquids above ground to allow maintenance, avoid human and property damage and facilitate commercial processes.

SUMMARY OF THE INVENTION

The present invention provides, in a first aspect, a system for use in diverting a liquid which includes a substantially impermeable liner and a plurality of supporting structures connectable to each other and configured for supporting the liner and a liquid when the liquid is received in the portion bounded by the liner. A first supporting structure of the plurality of supporting structures includes a first dam face, a first brace and a first base connecting said first dam face to said first brace. A second supporting structure of the plurality of supporting structures includes a second dam face, a second brace and a second base connecting the second dam face to the second brace. The first base is configured to be located on a ground surface to support the first supporting structure and the second base is configured to be located on the ground surface to support the second supporting structure. The first dam face and the second dam face contact and support the liner. The first dam face is connected to and inclined upwardly away from a first lower end of the first base. The second dam face is connected to and inclined upwardly away from a second lower end of the second base. The first dam face is connected to an upper end of the first brace and a second dam face is connected to a second upper end of the second brace. The first dam face is supported by the first brace and the second dam face is supported by the second brace. A plurality of link bars connects the first dam face and the second dam face. The plurality of link bars is vertically spaced from each other along longitudinal dimensions of the first dam face and the second dam face. The first dam face and the second dam face include slots on contacting surfaces of the first dam face and the second dam face contacting the liner. The slots receive the plurality of link bars connecting the first dam face and the second dam face.

The present invention provides, in a second aspect, a system for use in diverting a liquid which includes a first dam face for contacting and supporting a substantially impermeable liner for use in water diversion. An upper end of a first brace is connected to the first dam face such that the first brace is rotatable relative to and supports the first dam face. A first base is configured to be located on a ground surface and connects the first dam face to the first brace. The first dam face is inclined upwardly away from a first end of the base connected to a first lower end of the first dam face. The first dam face includes a plurality of slots in liner contacting surfaces thereof. The plurality of slots is configured to receive a plurality of link bars to allow a connection of the first dam face to the second dam face. The plurality of slots includes slots vertically spaced from each other along a longitudinal dimension of the first dam face.

The present invention provides, in a third aspect, a method for use in diverting a liquid which includes connecting a first supporting structure to a second supporting structure. The first supporting structure includes a first dam face, a first brace and a first base connecting the first dam face to the first brace. The second supporting structure includes a second dam face, a second brace and a second base connecting the first dam face to the second brace. The first dam face is connected to the second dam face by a plurality of link bars by receiving the link bars in a plurality of slots on liner contacting faces of the first dam face and the second dam face. Pairs of the plurality of slots and the plurality of link bars are longitudinally spaced from each other along longitudinal dimensions of the first dam face and the second dam face.

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention will be readily understood from the following detailed description of aspects of the invention taken in conjunction with the accompanying drawings in which:

FIG. 5 is a side view of the dam face of FIG. 4;

FIG. 6 is a blow-up of a side view of a round off toe of the dam face of FIG. 4;

FIG. 7 is a side view of a blow-up of a toe of the dam face of FIG. 5;

DETAILED DESCRIPTION OF THE INVENTION

Figure 1:
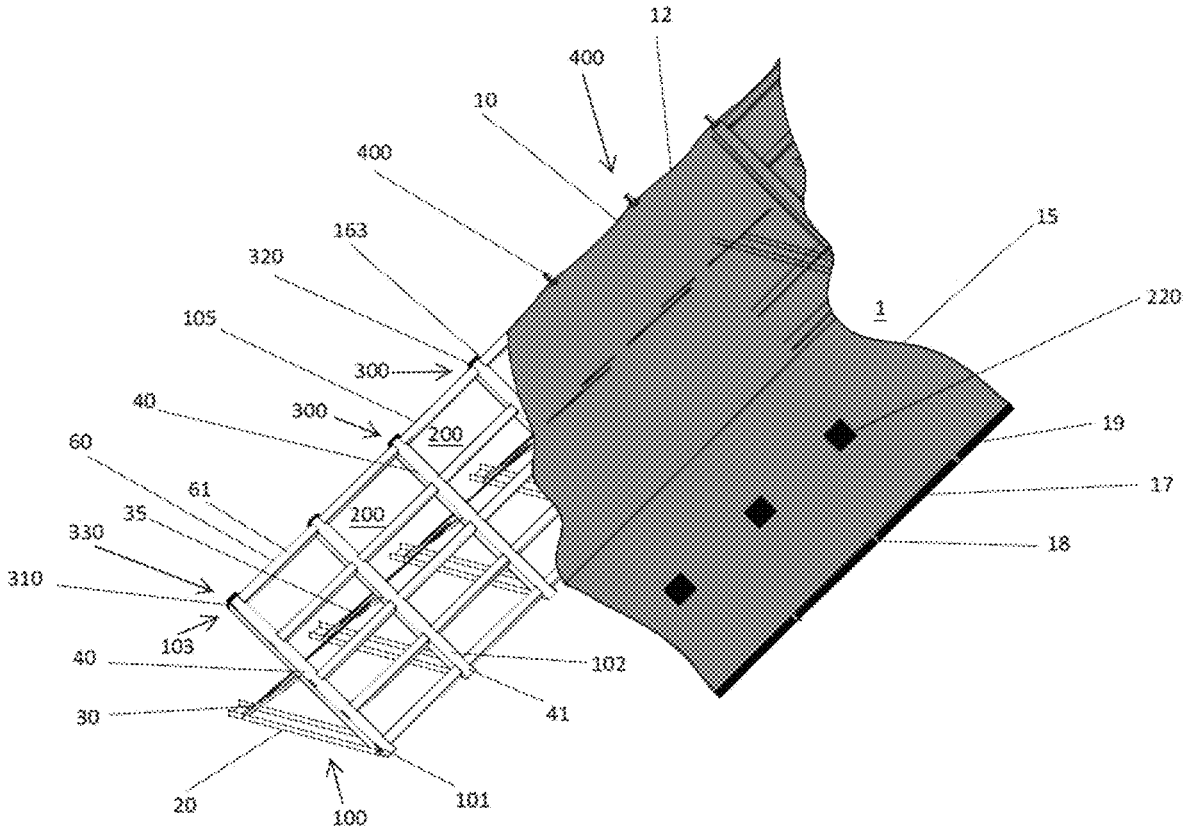
FIG. 1 is a perspective view of a system for diverting a liquid including frame supporting units supporting a liner.

The present invention will be discussed hereinafter in detail in terms of various exemplary embodiments according to the present invention with reference to the accompanying drawings. In the following detailed description, numerous specific details are set forth in order to provide a thorough understanding of the present invention. It will be obvious, however, to those skilled in the art that the present invention may be practiced without these specific details. In other instances, well-known structures are not shown in detail in order to avoid unnecessary obscuring of the present invention.

Thus, all the implementations described below are exemplary implementations provided to enable persons skilled in the art to make or use the embodiments of the disclosure and are not intended to limit the scope of the disclosure, which is defined by the claims. As used herein, the word "exemplary" or "illustrative" means "serving as an example, instance, or illustration." Any implementation described herein as "exemplary" or "illustrative" is not necessarily to be construed as preferred or advantageous over other implementations. Moreover, in the present description, the terms "upper", "lower", "left", "rear", "right", "front", "vertical", "horizontal", and derivatives thereof shall relate to the invention as oriented in FIG. 1.

Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

In accordance with the principals of the present invention, systems and methods for diverting liquids are provided. In an exemplary embodiment depicted in FIGS. 1-22, a flood protection or diversion system 5 is shown. Flood protection/diversion system 5 could be any type of water diversion barrier system, such as a water diversion structure, dam, flood control structure, or other structure for inhibiting or preventing movement of water through the barrier system toward an undesired area or areas.

Diversion system 5 may be configured (e.g., shaped and dimensioned) to any shape and to various heights. Diversion system 5 may include a series of interconnected supporting structures or frame units 100 spaced at intervals erected on a prepared surface (e.g., a concrete pad) or an irregular surface (e.g., a ground surface) to form a container skeleton or support structure for supporting a liner 10. Each frame unit, such as a frame 101 of frame units 100 depicted in FIGS. 1-3, includes a brace 30 and a dam face 40 facing a wet side portion 50 of the barrier system which may hold liquid such as water to inhibit movement thereof in an undesired direction. A base 20 may connect brace 30 and dam face 40.

Figure 2:
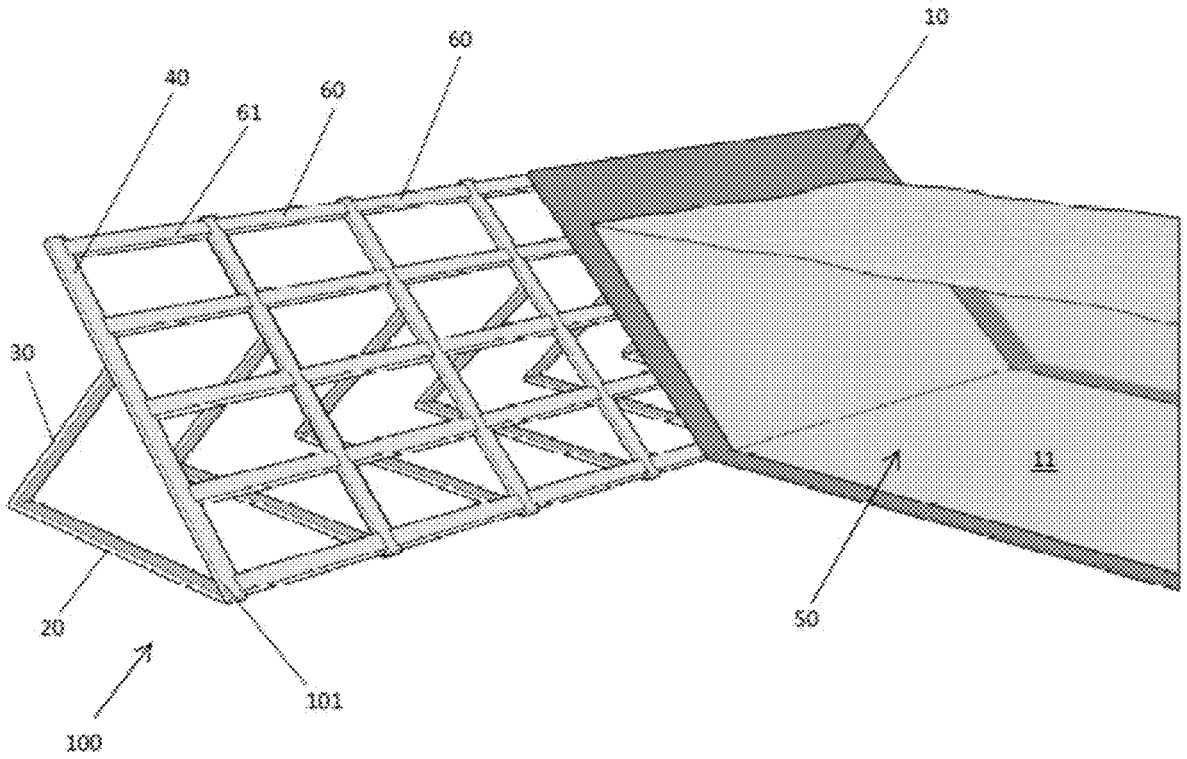
FIG. 2 is a perspective view of the system of FIG. 1 showing a liquid supported by the frame supporting units of FIG. 1.
Figure 3:
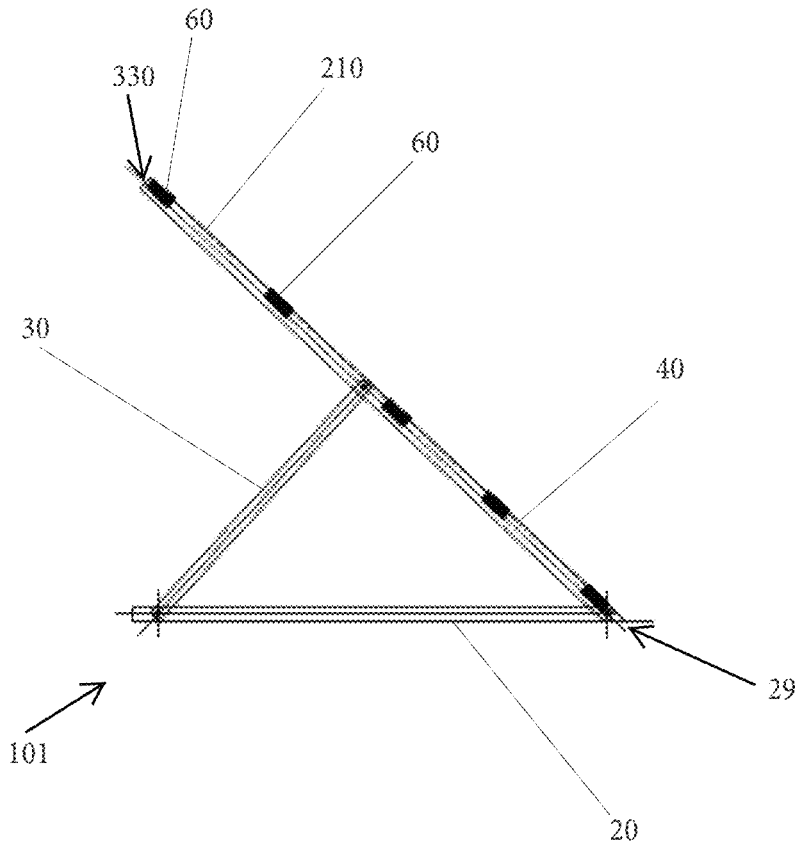
FIG. 3 is a side view of a frame unit of the frame units of FIG. 1.

A plurality of instances of dam face 40 of frame units 100 may extend upwardly at an angle (e.g., about 43 degrees relative to a longitudinal axis of base 20) to support diversion system 5 and any contents of liquid portion 50 as depicted in FIGS. 2-3. The dam faces may be supported (e.g., in horizontal and vertical directions) by a plurality of braces (e.g., multiple instances of brace 30). The braces, bases and dam faces of frame units 100 may be formed of wood, metal or plastic members fastened to each other and configured to carry the weight of a liquid 11 (e.g., water from a flood) of diversion system 5 to control a flood, divert water, or otherwise inhibit a flow of water in a particular direction past such frame units, as depicted for example in FIG. 2. Such braces, bases and dam faces could also be monolithically formed (e.g., by molding, casting, etc.). For example, the braces, bases and dam faces may be formed of cold-formed steel members which would meet or exceed AISI S100-12, North American Specification for the Design of Cold-Formed Steel Structural Members.

Figure 15:
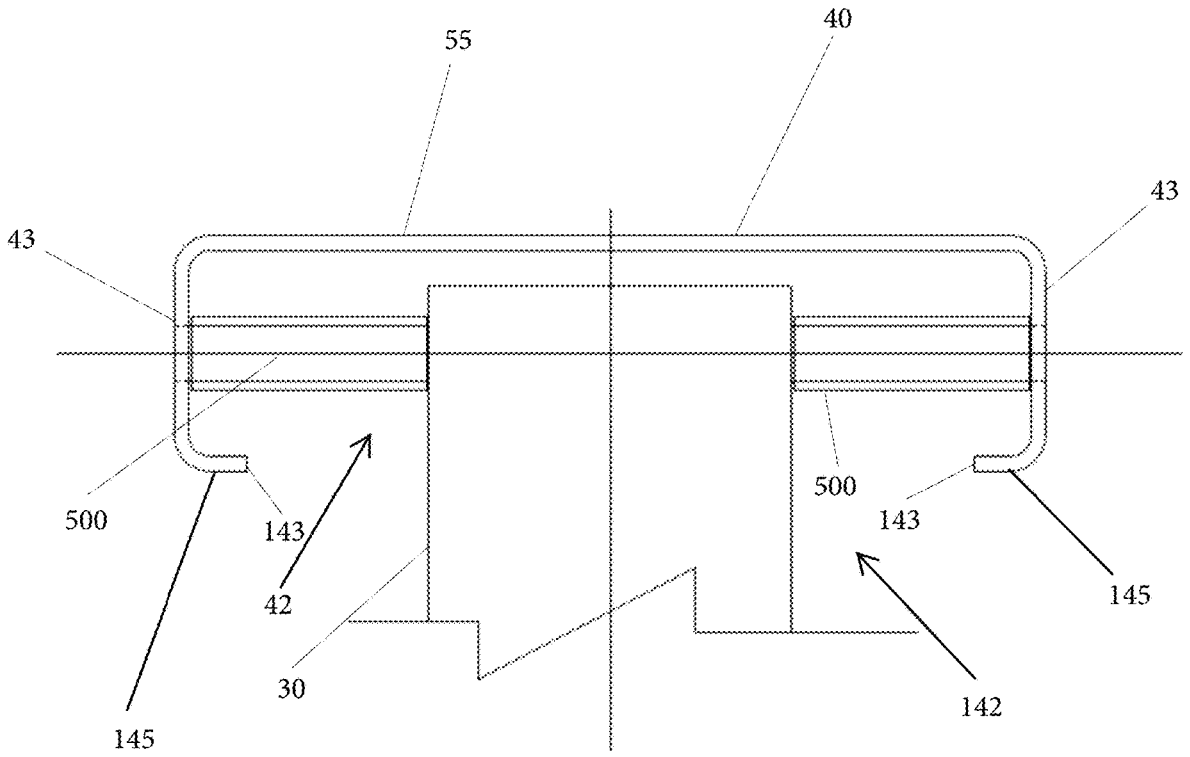
FIG. 15 is an end cross-sectional view of a dam face connected to a brace and utilizing a spacer according to the frame unit of FIG. 3.

As depicted in FIGS. 4-7, such a dam face (e.g., dam face 40) may include a solid flat top surface 55, solid vertical sides 43, and return lips 145 (FIG. 15), forming a U-shape with an open bottom side forming a cavity 42 (FIG. 15). Return lips 145 may extend horizontally inwardly and may be located on bottom ends 44 of vertical sides 43 providing resistance to lateral and vertical deformation. The 43-degree angle described above of dam face 40 relative to base 20 depicted in FIGS. 1-3 provides for larger downward water pressure than horizontal water pressure thus insuring maximum grip of a frame unit (e.g., frame 101) to a substrate, such as a ground surface 1 (FIGS. 1-3). A toe 47 may be located at a bottom end of dam face 40 and may be shaped such that top surface 55 is longer than ends 44 of vertical sides in a longitudinal direction relative to a longitudinal dimension of dam face 40 as depicted in FIGS. 5-7.

Figure 4:
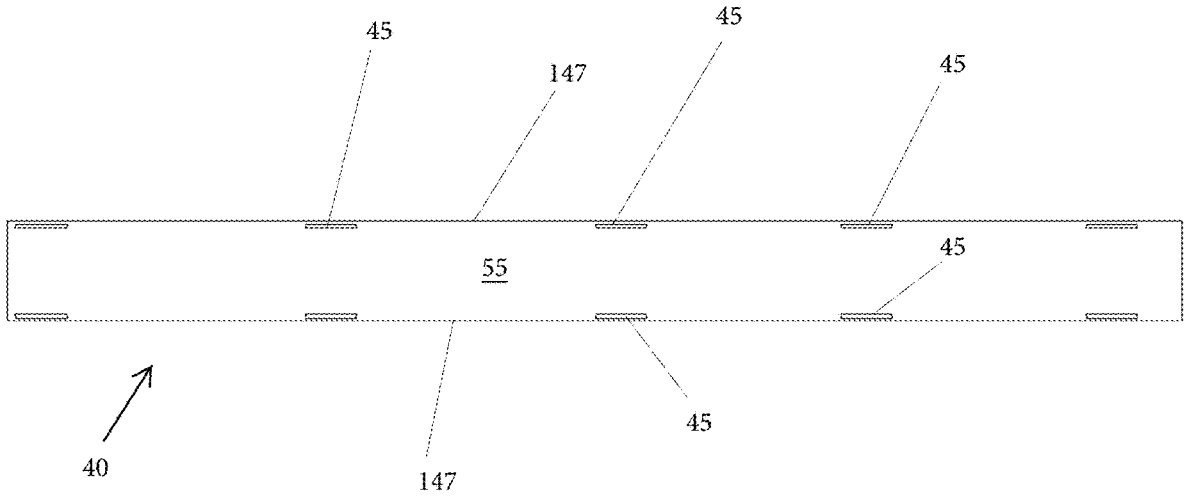
FIG. 4 is a top plan view of a dam face of the frame unit of FIG. 3.

A dam face (e.g., dam face 40) may include slots 45 through top surface 55 thereof spaced along a longitudinal dimension of the dam face and located at both edges to receive a plurality of link bars 60 therein as depicted in FIGS. 4-5. For example, slots 45 (e.g., 10 slots) may be spaced longitudinally on top surface 55. Slots 45 may be spaced longitudinally along dam face 40 and may be spaced normal to a longitudinal axis of dam face 40 on or near opposite edges 147 of dam face 40. For example, five sets of two slots of slots 45 located on opposite edges 147 may be longitudinally spaced along dam face 40 as depicted in FIGS. 1-4. Such spacing of slots may be equal spacing longitudinally along dam face 40 or such spacing may be unequal. The slots may be spaced from an edge of the dam face, e.g., at a spacing from the edge to best accept the link bar configuration.

For example, a first link bar 61 of link bars 60 may connect dam face 40 to a second dam face 41, identical to dam face 40, of an adjacent frame 102 as depicted in FIGS. 1-3 and 8-10. Link bar 61 may be shaped and dimensioned to fit into slots 45. Other of link bars 60 may be identical to link bar 61. Multiple instances of link bar 61 or link bars 60 may connect multiple instances of frame unit 100 to each other. For example, link bars 60 may be fit into the dam face slots (e.g., slots 45) with a vertical downward motion when the frame is erected, with the angle of the dam face being 43 degrees, the insertion of the link bar would then be in a 43 degree angle to a vertical motion.

Figure 8:
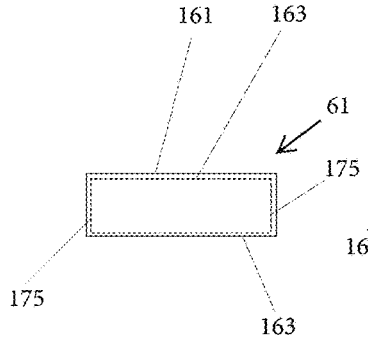
FIG. 8 is a left end view of a link bar of the frame unit of FIG. 3.
Figure 9:
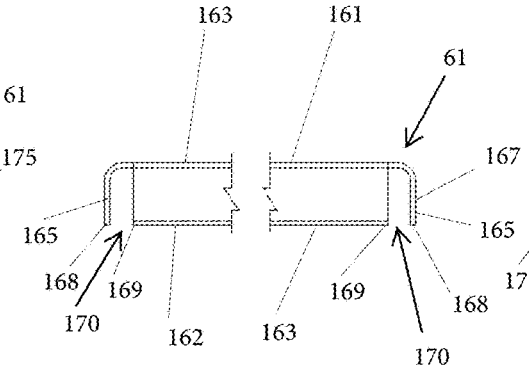
FIG. 9 is a side view of the link bar of FIG. 8.
Figure 10:
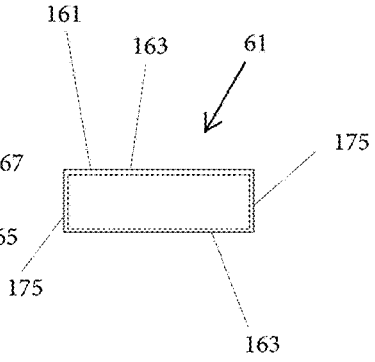
FIG. 10 is a right end view of the link bar of FIG. 8.

Link bar 61 may include a hollow rectangular member except with ends thereof cut (or otherwise formed) so that only a first side 161 (e.g., a top side) of long flat sides 163 extends beyond a remaining solid rectangular bar shape as depicted in FIGS. 8-10, for example. In particular, first side 161 may include bent down lips or downwardly depending arms 165. A second side 162 (e.g., a bottom) of long flat sides 163 may have a longitudinal dimension smaller than first side 161 as depicted in FIG. 9, for example. Opposite sides 175 (e.g., lateral portions) may have longitudinal dimensions identical or similar to each other and identical or similar to the longitudinal dimension of second side 162 such that first side 161 is larger than the other sides and arms 165 extend longitudinally beyond the other sides. Arms 165 may be bent inwardly (e.g., downwardly toward second side 162) at a 90-degree angle with respect to a longitudinal dimension of link bar 61 so as to be longitudinally aligned perpendicular relative to first side 161. Ends 168 of downwardly depending arms 165 may be spaced by gaps 170 (e.g., a ⅜" gap) from ends 169 of second side 162. A shape and dimension of arms 165 and gaps 170 may correspond to a slot size of slots (e.g., slots 45) in a dam face (e.g., dam face 40), a location of the slots on the dam face (e.g., spaced 3/16 in from an edge thereof), and a shape of the dam face to allow engaging portions or ends (e.g., ends 168) of such link bars (e.g., link bars 60) to be received in the slots (e.g., slots 45) to connect frame units 100 to each other.

For example, all the link bars (e.g., link bars 60) used in a particular system (e.g., diversion system 5) may be similar or identical to each other to allow installation of the link bars in any sequence. Such uniformity may also promote ease of installation by a single laborer and provide rapid deployment and repeated reliability.

As indicated above, dam face 40 may connect to a brace (e.g., brace 30) at a distance slightly less than half a length from a top 144 of dam face 40 via pivot pins 46 (FIG. 5) connected (e.g., welded) to inside surfaces of vertical sides (e.g., sides 43) of dam face 40 and received in one of openings 34 (FIG. 11) of the brace to connect the dam face to the brace. The connection via a pinned connection allows a brace (e.g., brace 30) to rotate with respect to the Dam Face (e.g., dam face 40) during assembly or disassembly. More specifically pin 46 may be welded between opposite vertical sides 43 bounding cavity 42 (FIG. 15) of dam face 40 and brace 30 may include openings 34 to receive pin 46, such that the brace may rotate relative to the dam face. For example, pin 46 may be inserted through an opening in a first side of vertical sides 43 of the dam face, through openings 34 of brace 30 and through a second opening in a second side of vertical sides; and pin 46 may be welded to vertical sides 43 to secure pin 46 and brace 30

Brace 30 may be an inclined rectangular member connecting base 20 to dam face 40 as depicted in FIGS. 1-3 and 11-12, for example. Brace 30 may be connected to dam face 40 such that a longitudinal axis of brace 30 is at approximately 90 degrees relative to a longitudinal axis of dam face 40. This perpendicular connection may maximize the brace's ability to transfer water pressure forces from the dam face 40 to base 20 connected to brace 30. Brace 30 may be pinned to dam face 40 via holes 34 through a short side 31 corresponding to pin 46 in dam face 40 and may be pinned to Base 20 to allow brace 30 to experience compressive forces only (i.e., no moment force transfer).

Figures 11, 12:
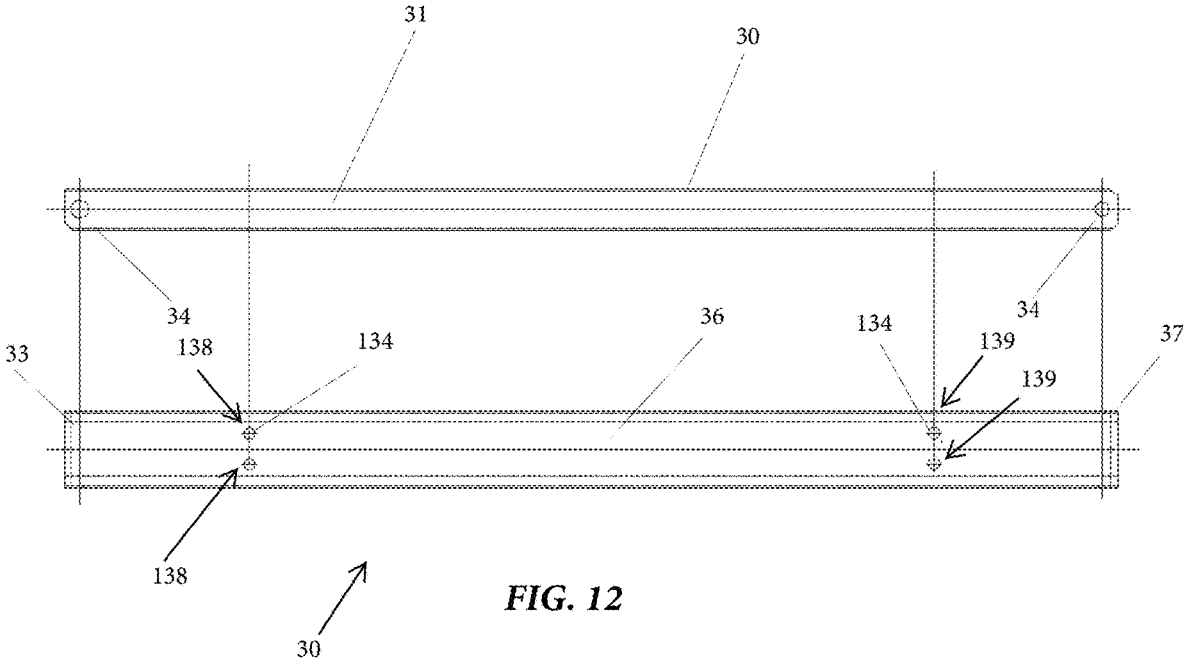
FIG. 11 is a side view of a brace of the frame unit of FIG. 3.
FIG. 12 is a top view of the brace of FIG. 11.

Brace 30 may have four holes 134 drilled through a longer flat side 36 thereof as depicted in FIG. 12. In an example, two of holes 134 may be at a distance of six inches from a top 33 and two of holes 134 may be at a distance of six (6) inches from the bottom 37, for example. The adjacent holes may be spaced at approximately 1 inch apart in a direction normal to a longitudinal axis of brace 30.

Figure 22:
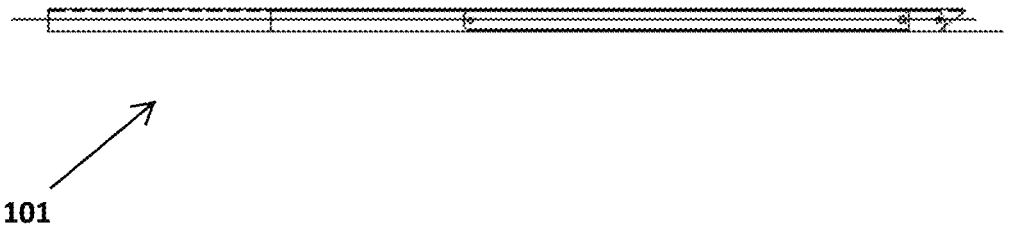
FIG. 22 is a side view of the frame unit of FIG. 3 in a folded configuration.

A width of brace 30 may be sized to fold up into cavity 42 of dam face 40 during disassembly thereby creating a low, flat profile for stacking and storage, as depicted in FIG. 22 for example. Further, an outer dimension (e.g., a width dimension) of dam face 40 may be dimensioned such that the width of dam face 40 is less than a width of base 20 and may thus be received thereon to allow for folding and storage of frame 101 and frame units 100 in a minimal amount of space.

Figure 18:
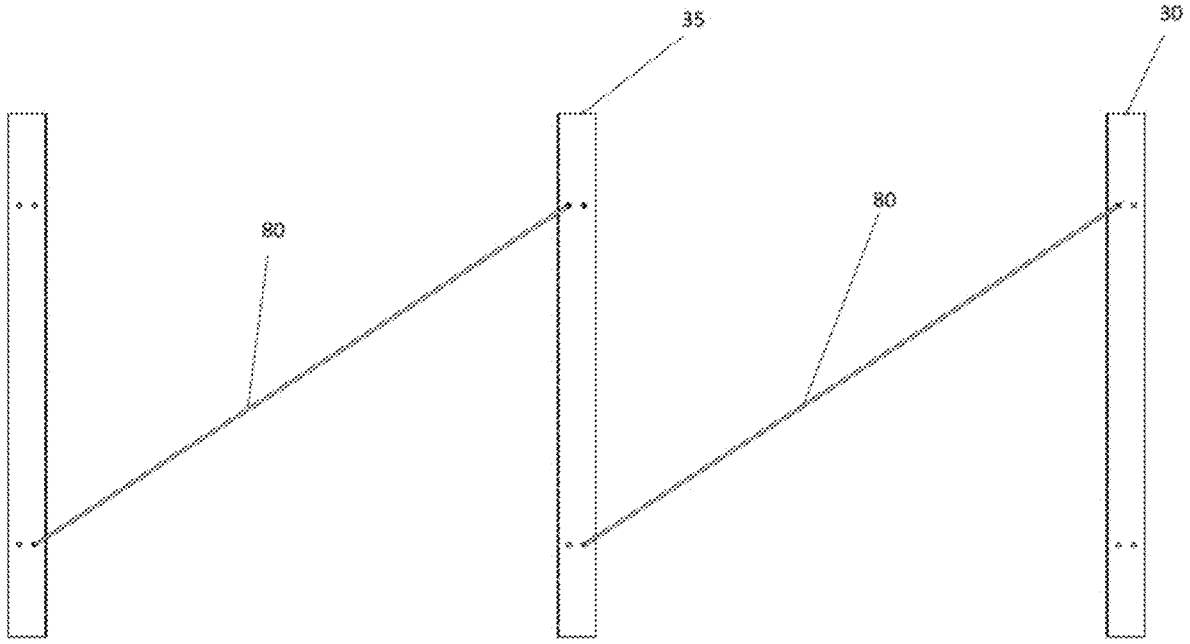
FIG. 18 is a rear view of three braces of FIG. 3 connected to each other via two of rod braces of FIG. 16.
Figure 19:
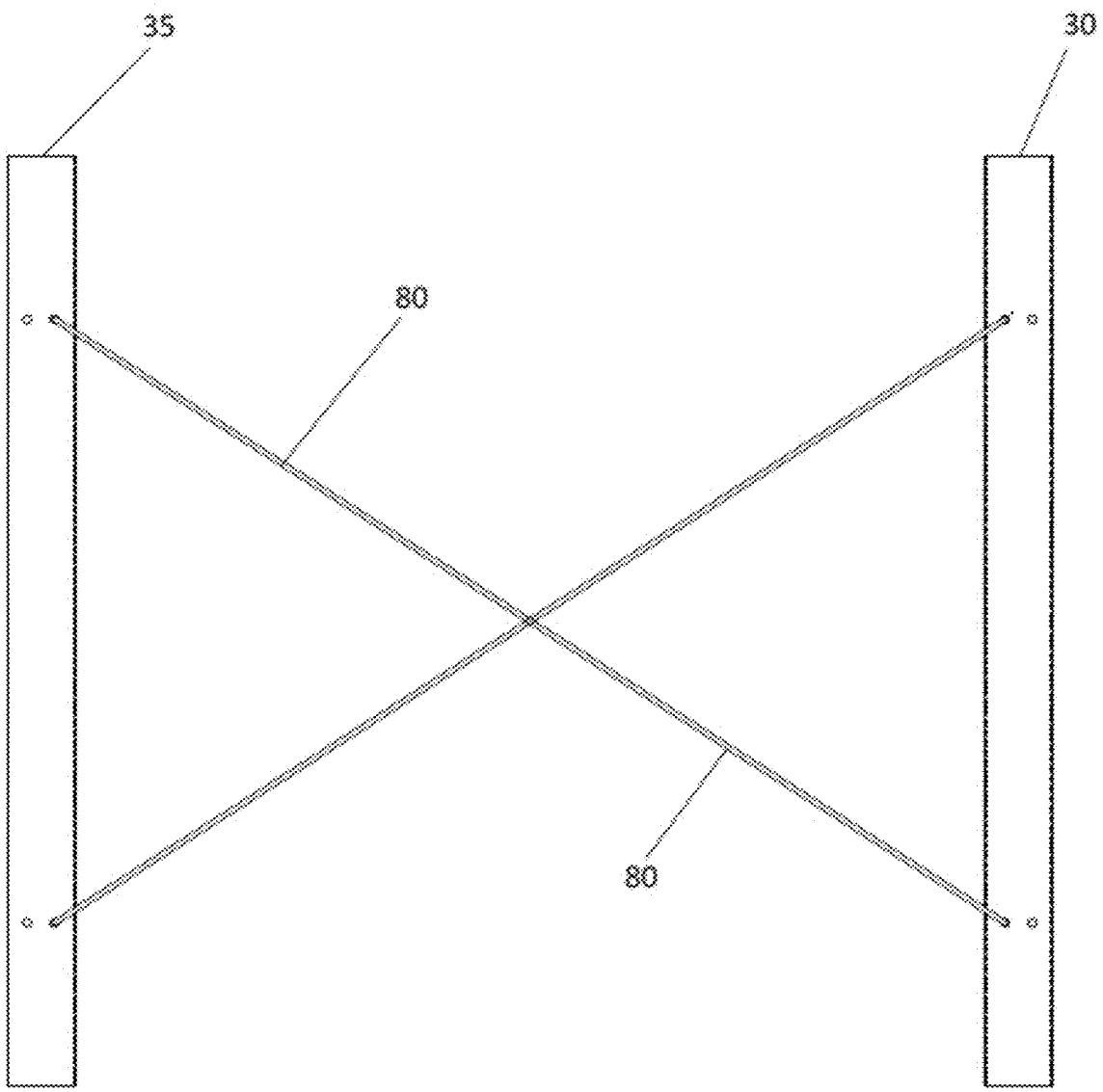
FIG. 19 is a rear view of two braces of FIG. 3 connected to each other via two of rod braces of FIG. 16.
Figure 20:
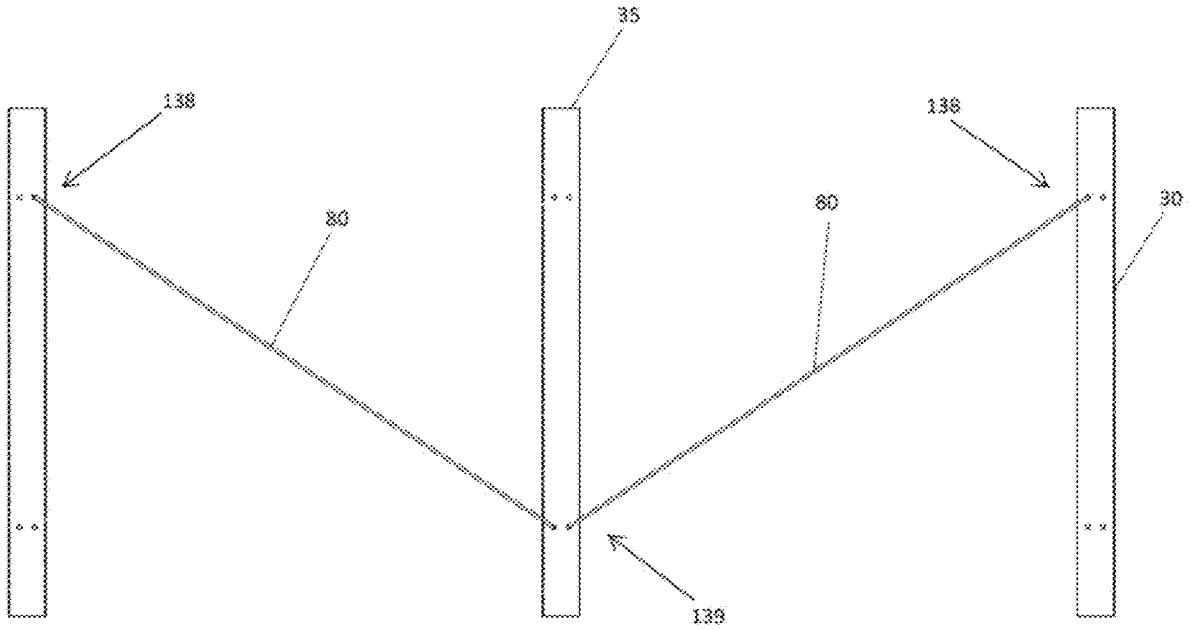
FIG. 20 is a rear view of three braces of FIG. 3 connected to each other via two of rod braces of FIG. 16.

Holes 134 of brace 30 may be configured (e.g., sized, shaped, and dimensioned) to receive ends 82 of rod braces 80 as depicted in FIGS. 18 and -19-20, which depicts two instances of brace 30 spaced at an appropriate (e.g., 36 inches) distance to receive one or more rod braces-one of which is depicted in FIG. 19.

Figure 16:
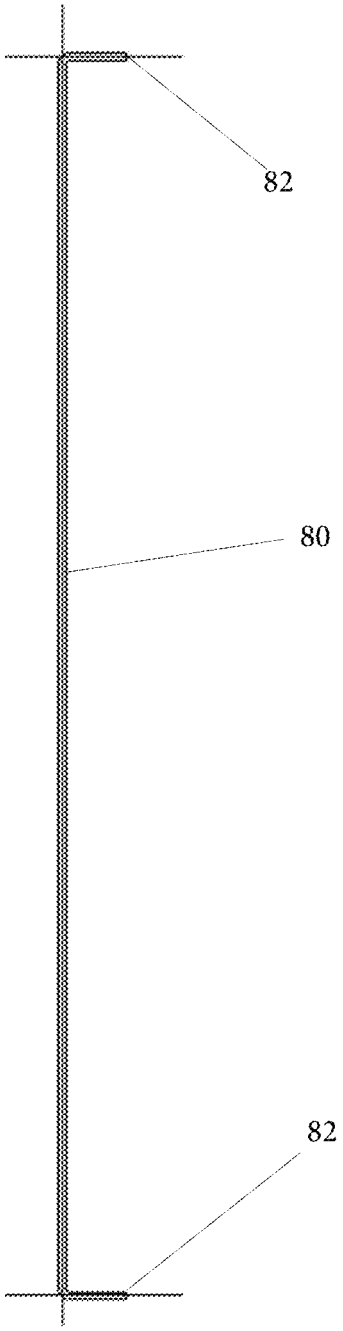
FIG. 16 is a side view of a rod brace connectable to the brace of FIG. 12.

In an example, rod braces 80 may be formed of a ¼" diameter rod with a 2⅛" bend at each end (e.g., ends 82) as depicted in FIG. 16. Bent ends (e.g., ends 82) of the rod brace may be inserted into the holes (e.g., holes 134 on longer flat side 36 of a brace (e.g., brace 30)) as depicted in FIGS. 12, 16 and 18-20. The locations and orientations of the rod braces (e.g., rod braces 80) relative to the braces (e.g., instances of brace 30) and frame units 100 may be dependent on field conditions encountered during erection of a system for diverting water (e.g., diversion system 5). For example, rod braces 80 may be inserted in top holes 138 of holes 134 of a first brace (e.g., brace 30) and bottom holes 139 of an adjacent brace similar or identical to the first brace (e.g., a brace 35, FIG. 1) and vice versa creating a "W" pattern (FIG. 20) or such rod braces (e.g., rod braces 80) may be inserted in an "X" pattern (FIG. 19) for horizontal stability as depicted in FIGS. 12 and 18-20, for example. Further, rod braces may be connected to braces such that a single rod brace connects adjacent braces (FIG. 18). For example, such rod braces (e.g., rod braces 80) may withstand enough tension so as to prevent settlement of a heal 28 (FIGS. 13-14) of base 20 when the base is installed on uneven surfaces thus maintaining an alignment of an overall structure (e.g., frame 101 or frame units 100).

Figure 13:
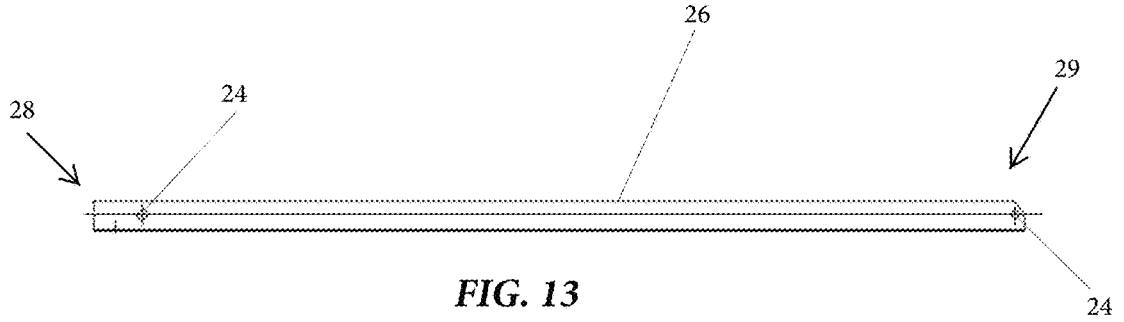
FIG. 13 is a side view of a base of the frame unit of FIG. 3.
Figure 14:
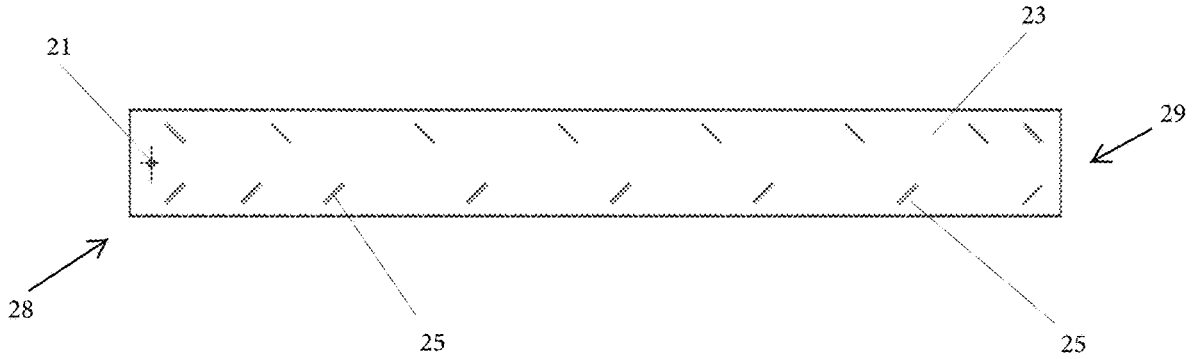
FIG. 14 is a top view of the base of FIG. 13.

As described above, base 20 may be connected to dam face 40 and brace 20. Base 20 may be a member that has a horizontal (e.g., largely flat) bottom 23 and upward pointing vertical sides 26 bounding a base cavity to form a U-shape, as depicted in FIGS. 13-14. There are linear downward protrusions 25 through bottom 23 at specific locations and angles. These protrusions provide additional interface friction with a substrate (e.g., a ground surface) to inhibit or prevent horizontal movement of a system (e.g., diversion system 5) due to the water pressure. Protrusions 25 may be 1½" long by ⅛" wide with the material (e.g., steel) from the protrusion bent downward relative to a remainder of bottom 23 at a 45-to-85-degree angle. Longitudinal axes of protrusions 25 may be aligned at 45 degrees inward to a longitudinal axis of base 20. This orientation (i.e., alignment of protrusions 25) may cause the substrate to compact between opposing protrusions and increase an interface friction between base 20 and the substrate. Holes 24 may be drilled through vertical sides 26 of base at a toe 29 and at heal 28. Holes 24 are utilized for connecting (e.g., via bolts) base 20 to dam face 40 at toe 29 via holes 46 and for connecting base 20 to brace 30 via a quick release pin at heal 28. Further, a spike hole 21 may be located in bottom 23 of base 20 near heal 28 to receive a ground spike (not shown) therethrough in the case of severe conditions at a location of a system (e.g., diversion system 5).

Also, a width dimension of base 20 may be at least slightly wider than any other component (e.g., dam face 40 and brace 30), allowing an "A" frame unit (e.g., formed of dam face 40 with brace 30 received therein) to fold inside the base creating a low, flat profile for stacking and storage, as depicted for example in FIG. 22.

Liner 10 may be a continuous liner impermeable to liquids (e.g., water) and may be installed on frame units 100 as depicted in FIGS. 1-2, for example. Liner 10 may be configured (e.g., shaped and dimensioned) to fit the inside measurements (e.g., the inside surface of multiple instances of dam face 40 and base 20) of a desired number of frame units 100 to form diversion system 5 and extend over a top (e.g., a top 105) of frame units 100.

Liner 10 may be a geosynthetic membrane with adequate elongation properties so as to create a slight ballooning effect into cavities 200 between link bars 60 and instances of dam face 40 when the liner is installed on frame units 100 and water is received in a barrier or diversion system (e.g., diversion system 5) such that water and resulting water pressure is applied against liner 10. Such pressure may cause liner 10 to descend past top surface 55 of dam face 40 and/or first side 161 of long flat sides 163 of link bar 61, for example. Such elongation of liner 10 such that the liner may partially wrap around a link bar (s) (e.g., link bars 60) and instances of dam face 40 to inhibit movement of the link bars and instances of the dam face in a direction perpendicular to longitudinal dimensions thereof to providing an overall locking-together action Liner 10 may also include one-way air valves 220 on a substrate contacting portion 15 which may contact a concrete pad or ground surface (e.g., an irregular ground surface) on a portion thereof adjacent a diversion system (e.g., diversion system 5) when the diversion system is installed as depicted in FIG. 1, for example. Air pockets may occur between a liner (e.g., substrate contacting portion 15) and the ground (e.g., ground 1) during installation of such a containment system. The air pockets could be detrimental to the sealing and stability of the overall system. One-way air valves 220 strategically placed in the liner (e.g., liner 10) allows a release of trapped air bubbles from below the liner. The release of these trapped air bubbles may assure a tight seal to the ground or other surface and minimize a potential for liner slippage relative to the ground or other surface.

A low profile ballast 17 may be placed along a leading edge 18 of a run-out portion (e.g., substrate contacting portion 15) of a liner (e.g., liner 10) to maintain a position thereof during rising water conditions as depicted in FIGS. 1-2, for example. Ballast 17 may inhibit or prevent leading edge 18 of the liner from moving when first encountered by the rising water. The low profile minimizes a build-up of rising water in front of the leading edge (e.g., leading edge 18) of the Liner (e.g., liner 10) allowing water onto a run-out portion (e.g., substrate contacting portion 15) thus quickly applying pressure on top of the liner to make secure a contact of the liner with the ground at a lowest level of the rising water. Ballast 17 may be received in a ballast pocket 19 of the liner (e.g., liner 10) or such ballast may be located on a top side thereof.

Elongation properties of a liner material and a puncture resistance strength thereof may allow for repeated impacts by floating debris without failure or leakage. Further, the flexibility and elongation properties of the liner material assure a tight seal between the liner and the substrate (e.g., ground 1) when deployed on uneven surfaces thus reducing or eliminating instances of leakage of water below the liner (e.g., liner 10).

Further, the liner may be any type of liner which may support the weight of water or another liquid when connected to frame units 100 and may be substantially impermeable. Also, liner 10 may be formed of a plurality of liner portions welded, overlapped, or otherwise connected to one another such that the seams are substantially impermeable.

Figure 17:
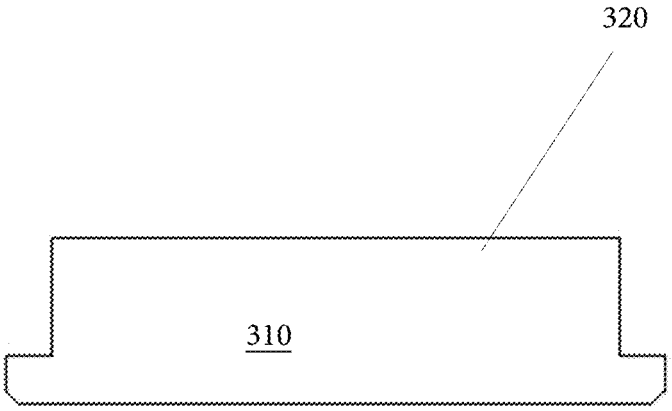
FIG. 17 is an end view of a wedge insertable into a cavity of the frame unit of FIG. 3.

As depicted in FIGS. 1, 3 and 17, for example, liner 10 may be connected to frame units 100 via wedges 300 and liner clips 400. A wedge 310 of wedges 300 may be similar or identical to other of wedges 300 and may include a central stem portion 320 configured (e.g., shaped and dimensioned) to be received in a wedge cavity 330 (e.g., a top end of cavity 42) in a top 103 of frame 101 of frame units 100 While a remainder of wedge 310 may be located outside such a cavity. Wedges 300 may be formed of wood or plastic, for example.

As depicted in FIG. 1, during a set up a system for diverting water (e.g., diversion system 5) liner 10 may be located on frame units 100 and secured by a plurality of liner clips 400 located on top portion 12 of liner 10 at locations of instances of wedge 310 received in cavities (e.g., cavity 330) such that each clip contacts the liner on opposite sides (on a front and back of system 5) of each wedge to hold liner 10 on the frame units forming the system (e.g., diversion system 5). The liner clips may include two spring loaded members, similar to a clothes pin, with a first of the members contacting a front side of liner 10 toward liquid 11 as depicted in FIG. 2 while a second of the members contacts a rear side of liner 10. The liner may also be held on frame units 100 via other fasteners providing pressure on opposite sides of instances of wedge 310 to hold the liner thereon.

As described above, dam face may be U-shaped and may include cavity 42 of which cavity 330 forms a top end thereof. Wedge 310 located in cavity 330 provides a structure for the liner clip to hold liner 10 against in the cavity. More specifically, the liner clip may provide a force on the front side of system 5 against liner 10 on top surface 55 of dam face 40 and on a rear side on liner 10 against wedge 310 received in cavity 330. The liner clip may thus hold liner 10 in place an inhibit the liner from moving downwardly along the front side (e.g., top surface 55 of dam face 40) of system 5.

As indicated above, wedge 310 may be formed of wood, plastic or another material which may provide a rigid structure in a cavity (e.g., cavity 330) to allow a frictional effect when a fastener (e.g., a clip) is attached to outside opposite surfaces of the liner and wedge, and further the wedge may be formed to minimize or inhibit damage to the liner due to contact thereof with frame units 100. For example, when frame units 100 are formed of steel, a use of wedge 310 may inhibit a likelihood of an edge of the metal forming one of frame units 100 from puncturing or cutting a liner (e.g., liner 10) received thereon due to the contact of the liner with the wedge (instead of the frame unit), since the wedge is formed of a material providing structure but not having a surface likely to cause damage to the liner even when placed under a stress or force.

As depicted in FIG. 15, spacers 500 may be utilized to facilitate a connection of brace 30 to dam face 40. In particular, dam face 40 may include cavity 42 bounded by solid flat top surface 55 and solid vertical sides 43 as described above. Pins 46, or other fastening members, may be connected to vertical sides 43 to connect brace 30 to dam face 40, as described above, for example. Spacers 500 may be received on opposite sides of such a fastening member within cavity 42 and with brace 30 between such spacers to inhibit or prevent lateral movement of brace 30 that may otherwise cause a contact of brace 30 with inside surfaces 143 of return lips 145 bounding an opening 142 into cavity 42 as depicted in FIG. 15. For example, spacers 500 may be received on pin 46 as pin 46 is inserted through openings 34 of brace 30 and prior to welding of pin 46 to vertical sides 43 of dam face 40 as described above.

Figure 21:
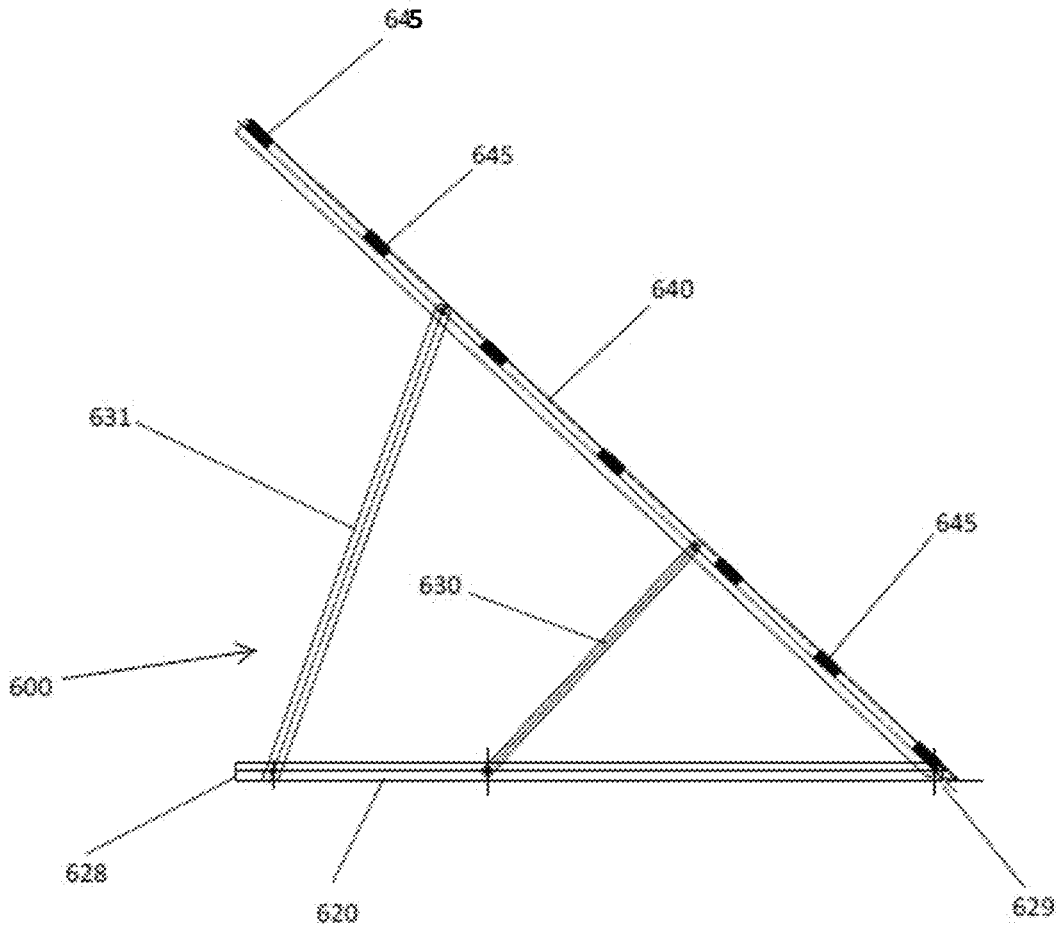
FIG. 21 is a side view of another example of a frame unit having two braces to support a dam face.

In an example depicted in FIG. 21, a frame 600 may be similar to frame 101 including a dam face 640, a brace 630 and a base 620. Further a second brace 631 may be located toward a heal 629 relative to brace 630. Second brace 631 may be aligned at a smaller angle than brace 630 relative to a longitudinal axis of dam face 640. Dam face 640 may include multiple slots 645 (e.g., 7 slots) to receive link bars (e.g., link bars 60) as described above relative to frame units 100. Frame 600 may have a large height (e.g., 60 in. or 72 in.) relative to frame units 100 (e.g., 36 in. or 42 in.) such that the use of two braces and additional link bars relative to frame units 100 may be desirable. For example, the use of two braces may provide additional support to dam face 640 relative to dam face 40 described above and thus may allow frame 600 to divert water at a height of water larger than frame 101 described above.

The above described systems (e.g., diversion system 5) and methods may be used for the temporary short or long term diversion of any form of liquid or slurry. Such systems are intended to be used above ground and are portable. In particular, the frame units (e.g., frame units 100) and separate hardware (e.g., pins) may be individually stacked and transported by truck to any location including very remote locations. The systems may be easily assembled, broken down and re-assembled at different locations. As described above, a brace (e.g., brace 30) may be received in a cavity (e.g., cavity 42) of a dam face (e.g., dam face 40) and the dam face may be connected to and/or received on a base (e.g., base 20) to allow stacking of instances (e.g., frame 101) of the frame units (e.g., frame units 100), as depicted in FIG. 22 for example. Further, each of frames 100 may be releasably connected to adjacent frames of frames 100 to form the structure of a system for water diversion (e.g., system 5) by a plurality of link bars (e.g., link bars 60) thereby allowing a system to be constructed in various sizes and shapes (e.g., by using different number of frame units 100 in different configurations) and allowing the easy deconstruction and movement of such a system from one place to another due to the releasable nature of the connections. The frames (e.g., frame units 100) may also be separated from each other and re-used after a system has achieved a particular purpose, for example. The assembly and re-assembly may be done by hand and/or with the assistance of lifting machinery.

Such systems for water diversion (e.g., diversion system 5) may be completely modular (e.g., multiple frame units 100 and liner 10 may form different shapes and sizes) and may be constructed into any shape or size configuration (e.g., 36 in. 48 in., 60 in. or 72 in. height) based on needs (e.g., water flow to be diverted) of a particular situation.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

The invention claimed is:

1. A system for use in diverting a liquid comprising:

a substantially impermeable liner;

a plurality of supporting structures connectable to each other and configured for supporting said liner and a liquid when the liquid is received in a portion bounded by said liner;

a first supporting structure of said plurality of supporting structures comprising a first dam face, a first brace and a first base connecting said first dam face to said first brace;

a second supporting structure of said plurality of supporting structures comprising a second dam face, a second brace and a second base connecting said second dam face to said second brace;

said first base configured to be located on a ground surface to support said first supporting structure and said second base configured to be located on the ground surface to support said second supporting structure;

said first dam face and said second dam face contacting and supporting said liner, said first dam face connected to and inclined upwardly away from a first lower end of said first base and said second dam face connected to and inclined upwardly away from a second lower end of said second base, said first dam face connected to an upper end of said first brace and said second dam face connected to a second upper end of said second brace such that said first dam face is supported by said first brace and said second dam face is supported by said second brace;

a plurality of link bars connecting said first dam face and said second dam face, said plurality of link bars vertically spaced from each other along longitudinal dimensions of said first dam face and said second dam face;

said first dam face and said second dam face comprising slots on contacting surfaces of said first dam face and said second dam face contacting said liner, said slots receiving said plurality of link bars connecting said first dam face and said second dam face; and wherein a first link bar of said plurality of link bars comprises a first end having a first arm configured to be received in a first slot of said first dam face and a second arm configured to be received in a second slot of said second dam face to connect said first dam face and said second dam face.

2. The system of claim 1 wherein said first base comprises a plurality of downwardly projecting members for gripping the ground surface.

3. The system of claim 1 further comprising cavities between said plurality of link bars and bounded by said plurality of link bars and said plurality of supporting structures, said cavities receiving portions of said liner in response to the liquid applying a force to said liner, said liner portions received in said cavities providing a resistance to a vertical and/or lateral movement of said plurality of link bars and said plurality of supporting structures.

4. The system of claim 1 further comprising a first cavity bounded by a first link bar and a second link bar of said plurality of link bars and said first dam face and said second dam face, said cavity receiving a first liner portion of said liner, said liner portion extending downwardly past top surfaces of said first link bar, said second link bar, said first dam face and said second dam face in response to the liquid applying a force to said liner, said liner portion received in said cavity providing a resistance to a vertical and/or lateral movement of said first link bar, said second link bar, said first dam face and said second dam face.

5. The system of claim 4 further comprising a second cavity bounded by a third link bar and a fourth link bar of said plurality of link bars and said second dam face and a third dam face, said second cavity receiving a second liner portion of said liner, said second liner portion extending downwardly past top surfaces of said third link bar, said fourth link bar, said second dam face and said third dam face in response to the liquid applying a force to said liner, said second liner portion received in said second cavity providing a resistance to a vertical and/or lateral movement of said third link bar, said fourth link bar, said second dam face and said third dam face, and wherein said first liner portion and said second liner portion are located on opposite sides of said second dam face to provide a resistance to movement of said second dam face.

6. The system of claim 4 further comprising a second cavity bounded by said second link bar and a third link bar of said plurality of link bars and said first dam face and said second dam face, said cavity receiving a second liner portion of said liner, said liner portion extending downwardly past top surfaces of said second link bar, said third link bar, said first dam face and said second dam face in response to the liquid applying a force to said liner, said second liner portion received in said second cavity providing a resistance to a vertical and/or lateral movement of said second link bar, said third link bar, said first dam face and said second dam face, and wherein said first liner portion and said second liner portion are located on opposite sides of said second link bar to provide a resistance to movement of said second link bar.

7. The system of claim 1 wherein said first brace and said second brace are connected to each other by a rod brace providing a resistance to a movement of said first brace and said second brace relative to each other.

8. The system of claim 7 further comprising a second rod brace connected to said first brace and said second brace, said first rod brace connected to a top of said first brace and a bottom of said second brace, and said second rod brace connected to a top of said second brace and a bottom of said first brace.

9. The system of claim 1 wherein said first supporting structure comprises a cavity in a top portion thereof, and further comprising a wedge inserted into said cavity, said liner contacting opposite sides of said wedge and held by a fastener to said wedge.

10. The system of claim 1 wherein said liner comprises a one-way valve to allow an escape of air from an underside of said liner to maximize contact of said liner with a ground surface thereby maximizing a friction of said liner with said ground surface.

11. The system of claim 1 wherein said first arm and said second arm of said first link bar are connected to each other by a central portion of said first link bar, said first arm having a first engaging portion having an engaging axis about perpendicular to a longitudinal axis of said central portion, said first engaging portion received in said first slot.

12. The system of claim 11 wherein said central portion comprises a top side, a bottom side and lateral sides, said first arm and said second arm extending from said top side and unconnected to said bottom side and said lateral sides.

13. The system of claim 12 wherein said central portion is received between said first dam face and said second dam face.

14. A system for use in diverting a liquid comprising:

a first dam face for contacting and supporting a substantially impermeable liner for use in a water diversion structure;

an upper end of a first brace connected to said first dam face such that said first brace is movable relative to and supports said first dam face;

a first base configured to be located on a ground surface and connecting said first dam face to said first brace;

said first dam face inclined upwardly away from a first end of said first base connected to a first lower end of said first dam face;

said first dam face comprising a plurality of slots on liner contacting surfaces thereof, said plurality of slots configured to receive a plurality of link bars to allow a connection of said first dam face to said second dam face, said plurality of slots comprising slots vertically spaced from each other along a longitudinal dimension of said first dam face; and a first link bar having a first end having a first arm configured to be received in a first slot of said first dam face and a second arm configured to be received in a second slot of a second dam face to connect said first dam face and said second dam face.

15. The system of claim 14 further comprising a second dam face connected to a second base and a second brace, said second dam face connected to said first dam face by said plurality of link bars, said first dam face and said second dam face supporting said liner.

16. The system of claim 15 wherein said liner is received in a cavity between two link bars of said plurality of link bars to inhibit lateral movement of said two link bars.

17. The system of claim 14 wherein said first dam face comprises a lower cavity bounded by lower surfaces of said first dam face and said cavity receiving an entirety of said first brace therein for storing or transporting said first dam face and said first brace.

18. The system of claim 14 wherein said first dam face comprises a cavity in a top portion thereof, and further comprising a wedge insertable into said cavity and configured to receive the liner and a fastener on opposite sides of said wedge to hold the liner on said wedge.

19. The system of claim 14 wherein said first arm and said second arm of said first link bar are connected to each other by a central portion of said first link bar, said first arm having a first engaging portion having an engaging axis about perpendicular to a longitudinal axis of said central portion, said first engaging portion received in said first slot.

20. The system of claim 19 wherein said central portion comprises a top side, a bottom side and lateral sides, said first arm and said second arm extending from said top side and unconnected to said bottom side and said lateral sides.

21. The system of claim 20 wherein said central portion is received between said first dam face and said second dam face.

22. A method for use in diverting a liquid comprising:

connecting a first supporting structure to a second supporting structure;

said first supporting structure comprising a first dam face, a first brace and a first base connecting said first dam face to said first brace;

said second supporting structure comprising a second dam face, a second brace and a second base connecting said second dam face to said second brace; and connecting said first dam face to said second dam face by a plurality of link bars by receiving said link bars in a plurality of slots on liner contacting faces of said first dam face and said second dam face; and wherein pairs of said plurality of slots and said plurality of link bars are longitudinally spaced from each other along longitudinal dimensions of said first dam face and said second dam face;

wherein a first link bar of said plurality of link bars has a first end having a first arm and a second arm, and wherein the connecting said first dam face to said second dam face comprises receiving said first arm in a first slot of said first dam face and receiving said second arm in a second slot of said second dam face.

23. The method of claim 22 further comprising locating a liner on said first dam face and said second dam face to inhibit a flow of liquid through said liner and past said first supporting structure and said second supporting structure.

24. The method of claim 23 further comprising connecting said liner to said first supporting structure and said second supporting structure by receiving a wedge in a cavity on a top of said first supporting structure and a second wedge in a second cavity on a second top of said second supporting structure and fastening the liner to the first wedge and the liner by a first fastener and a second wedge and the liner by a second fastener.

25. The method of claim 23 further comprising connecting said first brace to said second brace by a rod brace to inhibit movement of said first brace relative to said second brace.

26. The method of claim 23 wherein the locating the liner on said first dam face and said second dam comprises the liner being received in a cavity between a pair of said plurality of link bars, said first dam face and said second dam face and wherein a force of the liquid on the liner in the cavity inhibits movement of said first supporting structure and said second supporting structure relative to each other.

27. The method of claim 22 wherein said first arm and said second arm of said first link bar are connected to each other by a central portion of said first link bar, said first arm having a first engaging portion having an engaging axis about perpendicular to a longitudinal axis of said central portion, and wherein the connecting comprises said first engaging portion received in said first slot.

28. The method of claim 27, wherein said central portion comprises a top side, a bottom side and lateral sides, said first arm and said second arm extending from said top side and unconnected to said bottom side and said lateral sides.

29. The method of claim 28 wherein the connecting said first dam face to said second dam face comprises said central portion being received between said first dam face and said second dam face.

30. The method of claim 22 further comprising folding said first supporting structure by receiving said first brace in a cavity of said first dam face and receiving said first dam face within a base cavity of said first base, and folding said second supporting structure by receiving said second brace in a second cavity of said second dam face and receiving said second dam face within the base cavity of said second base, and stacking said second support structure on said first support structure.

31. A system for use in diverting a liquid comprising:

a substantially impermeable liner;

a plurality of supporting structures connectable to each other and configured for supporting said liner and a liquid when the liquid is received in a portion bounded by said liner;

a first supporting structure of said plurality of supporting structures comprising a first dam face, a first brace and a first base connecting said first dam face to said first brace;

a second supporting structure of said plurality of supporting structures comprising a second dam face, a second brace and a second base connecting said second dam face to said second brace;

said first base configured to be located on a ground surface to support said first supporting structure and said second base configured to be located on the ground surface to support said second supporting structure;

said first dam face and said second dam face contacting and supporting said liner, said first dam face connected to and inclined upwardly away from a first lower end of said first base and said second dam face connected to and inclined upwardly away from a second lower end of said second base, said first dam face connected to an upper end of said first brace and said second dam face connected to a second upper end of said second brace such that said first dam face is supported by said first brace and said second dam face is supported by said second brace;

a plurality of link bars connecting said first dam face and said second dam face, said plurality of link bars vertically spaced from each other along longitudinal dimensions of said first dam face and said second dam face; and said first dam face and said second dam face comprising slots on contacting surfaces of said first dam face and said second dam face contacting said liner, said slots receiving said plurality of link bars connecting said first dam face and said second dam face;

wherein said first supporting structure comprises a cavity in a top portion thereof, and further comprising a wedge inserted into said cavity, said liner contacting opposite sides of said wedge and held by a fastener to said wedge.

32. A system for use in diverting a liquid comprising:

a first dam face for contacting and supporting a substantially impermeable liner for use in a water diversion structure;

an upper end of a first brace connected to said first dam face such that said first brace is movable relative to and supports said first dam face;

a first base configured to be located on a ground surface and connecting said first dam face to said first brace;

said first dam face inclined upwardly away from a first end of said first base connected to a first lower end of said first dam face;

said first dam face comprising a plurality of slots on liner contacting surfaces thereof, said plurality of slots configured to receive a plurality of link bars to allow a connection of said first dam face to said second dam face, said plurality of slots comprising slots vertically spaced from each other along a longitudinal dimension of said first dam face; and wherein said first dam face comprises a cavity in a top portion thereof, and further comprising a wedge insertable into said cavity and configured to receive the liner and a fastener on opposite sides of said wedge to hold the liner on said wedge.

33. A method for use in diverting a liquid comprising:

connecting a first supporting structure to a second supporting structure;

said first supporting structure comprising a first dam face, a first brace and a first base connecting said first dam face to said first brace;

said second supporting structure comprising a second dam face, a second brace and a second base connecting said second dam face to said second brace; and connecting said first dam face to said second dam face by a plurality of link bars by receiving said link bars in a plurality of slots on liner contacting faces of said first dam face and said second dam face;

wherein pairs of said plurality of slots and said plurality of link bars are longitudinally spaced from each other along longitudinal dimensions of said first dam face and said second dam face;

locating a liner on said first dam face and said second dam face to inhibit a flow of liquid through said liner and past said first supporting structure and said second supporting structure; and connecting said liner to said first supporting structure and said second supporting structure by receiving a wedge in a cavity on a top of said first supporting structure and a second wedge in a second cavity on a second top of said second supporting structure and fastening the liner to the first wedge and the liner by a first fastener and a second wedge and the liner by a second fastener.

* * * * *